US006046443A

United States Patent [19]

Ackerman et al.

[11] Patent Number: 6,046,443

[45] Date of Patent: Apr. 4, 2000

[54] GUSSETED BAG WITH ANTI-LEAK FEATURE

[75] Inventors: Corey P. Ackerman, Sibley; Mark K. Sterler, Ocheyedan; James L. Monier, Sibley, all of Iowa

[73] Assignee: International Paper Company

[21] Appl. No.: 09/304,178

[22] Filed: May 3, 1999

[51] Int. Cl.[7] ..... H05B 6/80; B65D 30/20

[52] U.S. Cl. ..... 219/727; 219/730; 426/234; 426/107; 99/DIG. 14; 383/120

[58] Field of Search ..... 219/727, 730, 219/725; 426/107, 109, 111, 113, 234, 243; 383/120, 123, 124; 99/DIG. 14

[56] References Cited

U.S. PATENT DOCUMENTS

| | | | |
|---|---|---|---|
| 4,607,388 | 8/1986 | Koiyumaki et al. . | |
| 4,691,374 | 9/1987 | Watkins . | |
| 5,044,777 | 9/1991 | Watkins . | |
| 5,195,829 | 3/1993 | Watkins . | |
| 5,326,576 | 7/1994 | Zuege . | |
| 5,401,102 | 3/1995 | Faltynek et al. | 383/120 |
| 5,461,216 | 10/1995 | McDonald . | |
| 5,474,383 | 12/1995 | Zuege . | |
| 5,488,220 | 1/1996 | Freeks et al. | 219/727 |
| 5,498,080 | 3/1996 | Dalea . | |
| 5,650,084 | 7/1997 | Bley . | |
| 5,690,853 | 11/1997 | Jackson . | |
| 5,753,859 | 5/1998 | Olson . | |

FOREIGN PATENT DOCUMENTS

| | | |
|---|---|---|
| 831774 | 3/1960 | United Kingdom . |

*Primary Examiner*—Philip H. Leung
*Attorney, Agent, or Firm*—Dennis H. Lambert

[57] ABSTRACT

A bag for popping popcorn in a microwave oven has substantially rectangular front and back walls and gusseted side walls joining the opposite side edges of the front and back walls. The gusseted side walls each has a medial gusset fold, defining a pair of gusset panels joined along longitudinal folds to the adjacent side edges of the respective front and back walls. When the bag is folded flat, the gusset panels and medial gusset folds lie between the front and back walls, with the medial gusset folds of the opposite gusseted side walls normally spaced from one another. Transverse bands of adhesive extend across the top and bottom ends of the bag interior surface to adhesively attach the gusset panels to the respective front and back walls, forming bag end closures. The gusseted side walls intersect and extend through the bag end closures, and small spots of flowable adhesive are placed in the bag end closure at the locations where the medial gusset folds intersect the bag end closure, to fill any voids or spaces that may exist at those locations.

12 Claims, 4 Drawing Sheets

GUSSETED BAG WITH ANTI-LEAK FEATURE

FIELD OF THE INVENTION

This invention relates in general to gusseted bags. More particularly, the invention relates to a microwave cooking bag having an anti-leak feature.

BACKGROUND OF THE INVENTION

There are many known bags for holding articles, including bags for storing and cooking food in microwave ovens. Popcorn, for example, is commonly packaged in gusseted bags that may be placed in a microwave oven to pop the popcorn. Such bags typically comprise front and back walls joined by gusseted side walls, with a microwave susceptor in one of the front and back walls for absorbing microwave energy and heating the contents of the bag. The gusseted side walls enable the bag to be folded flat for storage and shipment, but unfold and enable the bag to expand when the food inside the bag is cooked. The ends of the bag are closed and sealed by transverse bands of adhesive on the interior end surfaces of the front and back walls and the gusset folds. The bands of adhesive are applied during manufacture of the bag, and after the bag is folded to form a tubular structure with gusseted sides, heat and pressure is applied to the ends of the folded bag, thereby adhesively attaching the adjacent interior surfaces where the transverse bands of adhesive are located.

When the bag is in its folded flat condition, the inner folded edges of the gusseted side walls lie between the front and back walls and in spaced apart relationship to one another, whereby there are four layers of bag wall material along opposite sides of the bag, i.e., in the area where the gusset folds are interposed between the opposite side edges of the front and back walls, but there are only two layers of bag wall material along the longitudinal centerline of the bag, i.e., in the area between the inner edges of the gusset folds where the front and back walls are in opposed contiguous relationship. This difference in layers results in a transition in thickness, or a step, adjacent each inner folded edge of the gusseted sides. Where the gusset folds extend through the adhesive band forming the end closure of the bag, this step can result in a small unsecured area, or an area of weakened adhesive attachment, whereby a channel is formed, or can form, through the end closure, enabling cooking oil or other material to leak from the interior of the bag during and after cooking.

This specific problem has not been addressed in the prior art, although UK patent number 831,774 to HESSER recognized a similar problem where the longitudinal seam of a rectangular bag crosses the transverse seam closing the end of the bag. The bag in HESSER does not have gusseted side walls and therefore does not present the same problem that is solved by the present invention, i.e., to preclude the formation of an unsealed area or channel at the area where gusset folds extend through a bag end closure, to thereby prevent leakage of cooking oil or other material from the interior of the bag. HESSER appears to be primarily concerned with strengthening or reinforcing adhesively secured areas where a longitudinal seam crosses a transverse seam, especially at the exterior of the bag. See page 1, lines 26–35, 40–46 and 52–53. Further, HESSER appears to solve this problem by applying an additional layer of the heat sealable adhesive that is used to make the transverse and longitudinal seals in the bag. See page 2, lines 25–40.

U.S. Pat. No. 3,358,903 (De Stefano) and U.S. Pat. No. 5,461,261 (McDonald) address the problem of leakage through the walls or seams of gusseted bags, but De Stefano is concerned with leakage through longitudinal side seams formed in the medial fold of the gusseted side walls, and McDonald is concerned with leakage through the longitudinal folds of the gusseted side walls. Neither of these patents is concerned with the formation of channels where the gusset folds cross the end seam of a gusseted bag. De Stefano forms his bag by folding a web of material such that edges of the material are joined at seams extending longitudinally along the inner gusset folds, and reinforces this joint by applying extra adhesive, or using special folds, or extra adhesive and tape. McDonald addresses the problem of leakage through the longitudinal folded edges of the bag caused by damage to the fibers of the bag material when it is folded, and applies a strip or layer of adhesive in the crease of these folds to solve the problem.

U.S. Pat. No. 5,326,576 (Zuege) applies an extra patch of adhesive in the transverse seam at the top end of the bag to hold one side of the bag closed during filling, but he does not address the problem of leakage, nor would his extra patches of adhesive serve any useful function in this regard.

U.S. Pat. No. 4,691,374 (Watkins), U.S. Pat. No. 5,195,829 (Watkins), U.S. Pat. No. 5,498,080 (Dalea), U.S. Pat. No. 5,650,084 (Bley), U.S. Pat. No. 5,690,853 (Jackson), and U.S. Pat. No. 5,753,895 (Olson) all apply extra patches of adhesive in a location on the bag that generally coincides with the location of the bag end closure, but the extra patches of adhesive in these patents are applied externally of the bag rather than internally, and are for the purpose of preventing separation of the gussets at the bottom end of the bag, or forming a stiffening stay across the bottom, or to facilitate the formation of a square bottom, rather than for preventing leakage through the end closure.

Consequently, a need exists for an inexpensive and effective way of sealing and closing the channels or openings that may form through the bag end closure of a gusseted bag where the gusset folds extend through the closure, thereby preventing leakage of cooking oil or other material through the closure.

SUMMARY OF THE INVENTION

In accordance with the present invention, means is provided to close and seal the small openings or channels that may form where the inwardly disposed medial gusset folds of a gusseted bag extend across the end closure seal, thereby preventing leakage of cooking oil or other material from the interior of the bag through this area.

More specifically, the means provided by the invention for closing and sealing these openings or channels comprise small patches or spots of adhesive applied during manufacture of the bag to its inner surface in areas corresponding to the location where the inwardly disposed medial gusset folds will intersect the bag end closure seal when the bag is folded to form a tubular structure with gusseted sides.

In a preferred construction, the spots comprise a flowable adhesive which is applied to the bag in a flowable condition and in a sufficient amount so that when the panels are folded upon one another and pressed to seal them together, the spots are capable of deforming to spread and fill the spaces or channels that may exist immediately adjacent the inner medial gusset folds where they cross or intersect the end seal. The spots are applied in the field of the transverse band of adhesive that forms the end seal and closure, spaced slightly from the interior edge of the adhesive field. They may be applied on the line that defines the medial gusset fold of the gusseted sides, or they may be applied on the front or back panel where these medial gusset folds will intersect the end seal when the bag is folded flat.

Other than the incorporation of the spots of adhesive as described above, the bag of the invention is constructed conventionally and functions normally during filling, cooking and dispensing of food cooked therein.

BRIEF DESCRIPTION OF THE DRAWINGS

The foregoing as well as other objects and advantages of the invention will become apparent from the following detailed description when considered in conjunction with the accompanying drawings, wherein like reference characters designate like parts throughout the several views, and wherein.

DETAILED DESCRIPTION OF THE PREFERRED EMBODIMENTS

Referring more specifically to the drawings, a bag in accordance with the invention is indicated generally at 10 in FIGS. 1–7. The bag includes generally rectangular front and back walls 11 and 12, respectively, joined at opposite side edges by gusseted side walls 13 and 14, closed and sealed at its opposite ends to define a closed top end 15 and a closed bottom end 16.

Figure 1:
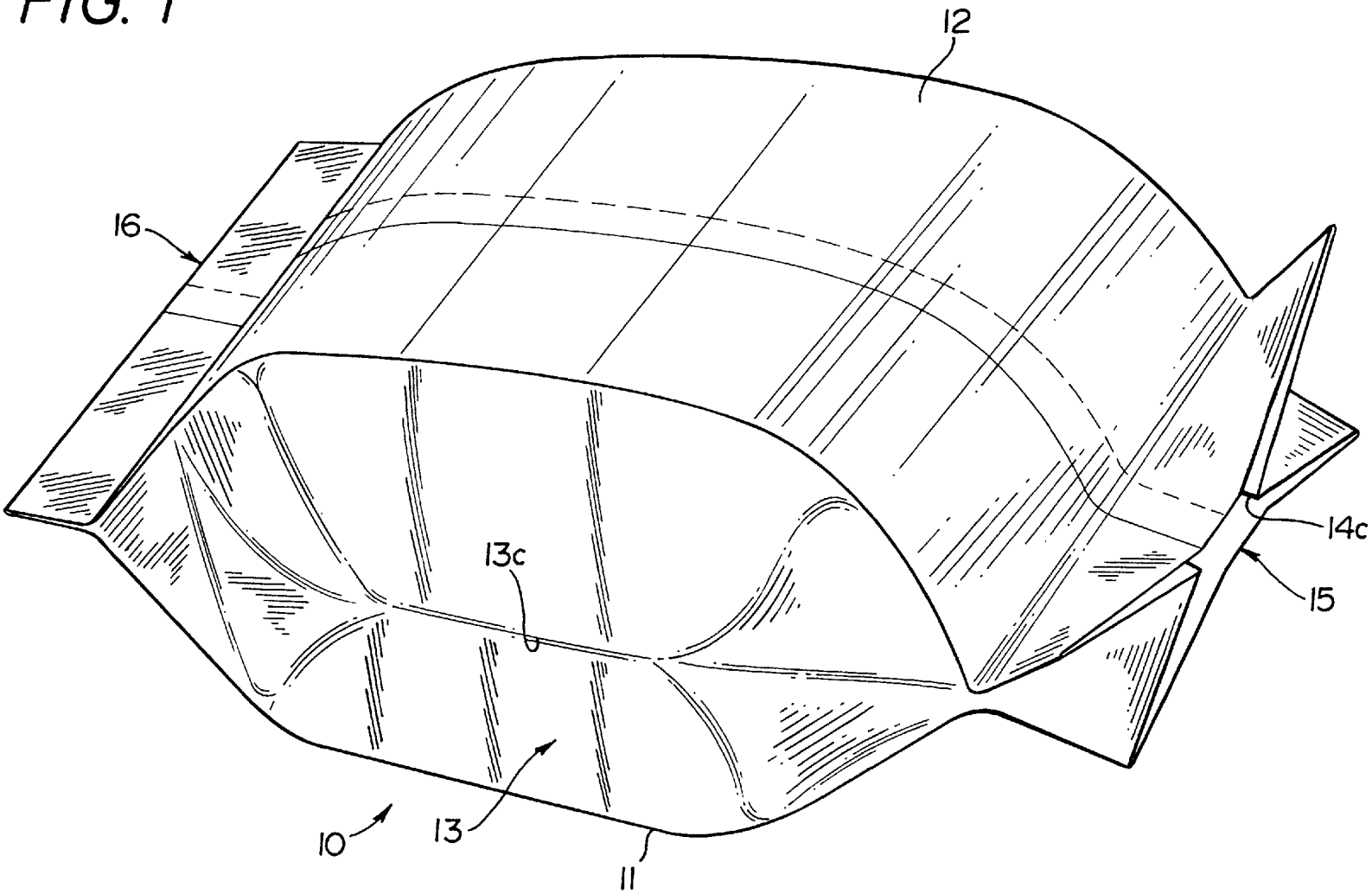
FIG. 1 is a top perspective view of a bag for microwave cooking of popcorn incorporating the features of the invention.
Figure 2:
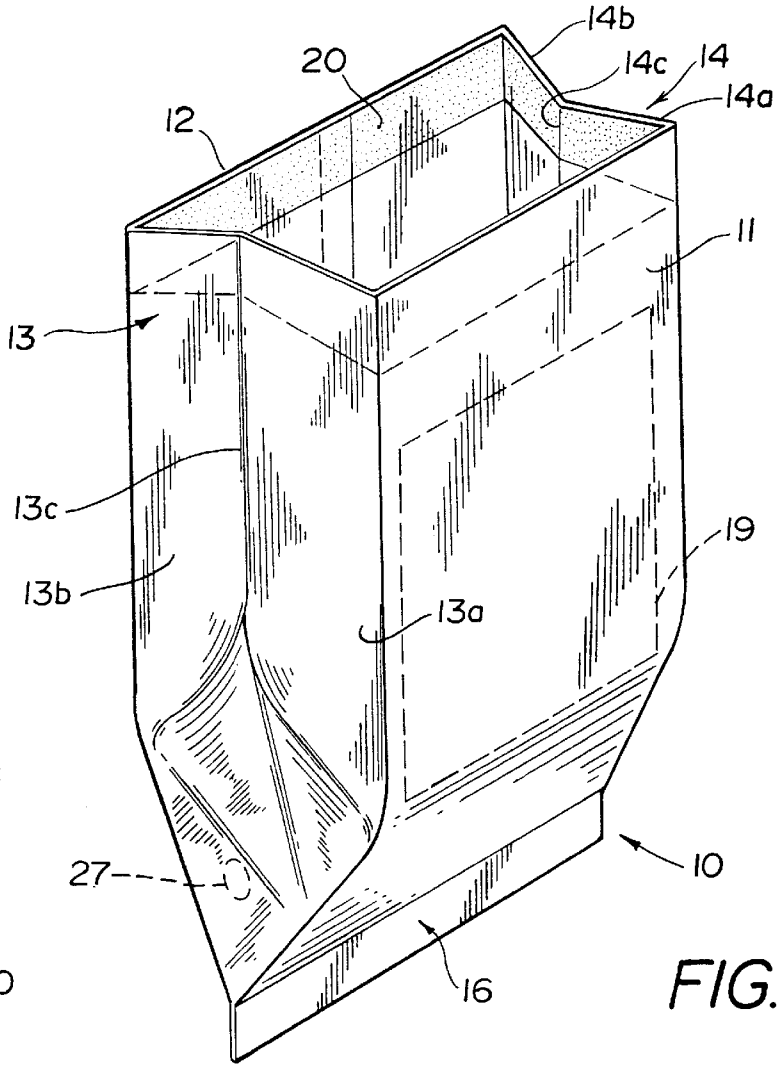
FIG. 2 is a top perspective view of the bag of FIG. 1, shown expanded and in an upright position with the upper end open.
Figure 3:
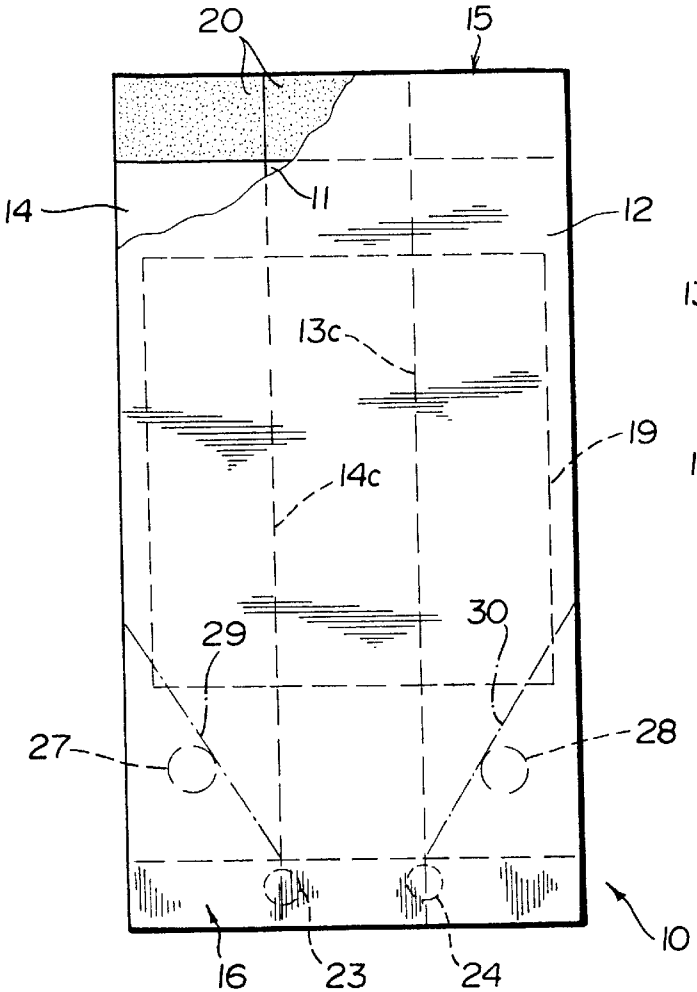
FIG. 3 is a plan view of the bag of FIGS. 1 and 2, shown in its flattened or unexpanded condition.
Figure 6:
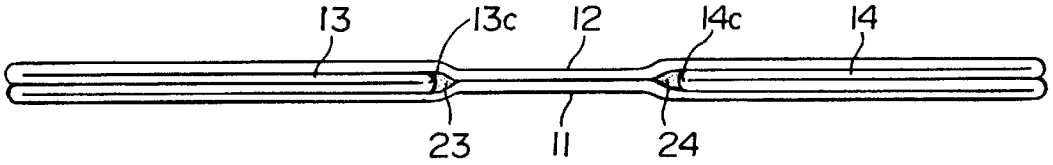
FIG. 6 is a somewhat schematic end view, on an enlarged scale, of the bottom end of the bag according to the invention, showing how the flowable spots of adhesive close and seal the spaces that could otherwise exist where the inner, medial gusset folds cross the end seal on the bag.

The gusseted side walls 13 and 14 comprise first and second gusset panels 13*a*, 13*b* and 14*a*, 14*b*, respectively, joined along medial fold lines 13*c* and 14*c*, respectively, whereby the gusset side panels may be folded inwardly about the edges of the respective front and back walls so that the gusset panels lie between the front and back walls when the bag is in its fully folded, collapsed condition as depicted in FIGS. 3 and 6, with the medial folded edges 13*c* and 14*c* thereof spaced from one another.

In a preferred embodiment of the invention, the bag is of multiple ply construction, including an inner grease-proof ply of paper 17 adhesively laminated to an outer ply of paper 18 suitable for applying graphics thereto, with a susceptor 19 of microwave interactive material laminated between the plies. It should be understood, however, that other bag wall constructions could be employed, such as a single ply construction, for example, with any suitable susceptor suitably affixed thereto.

Figure 4:
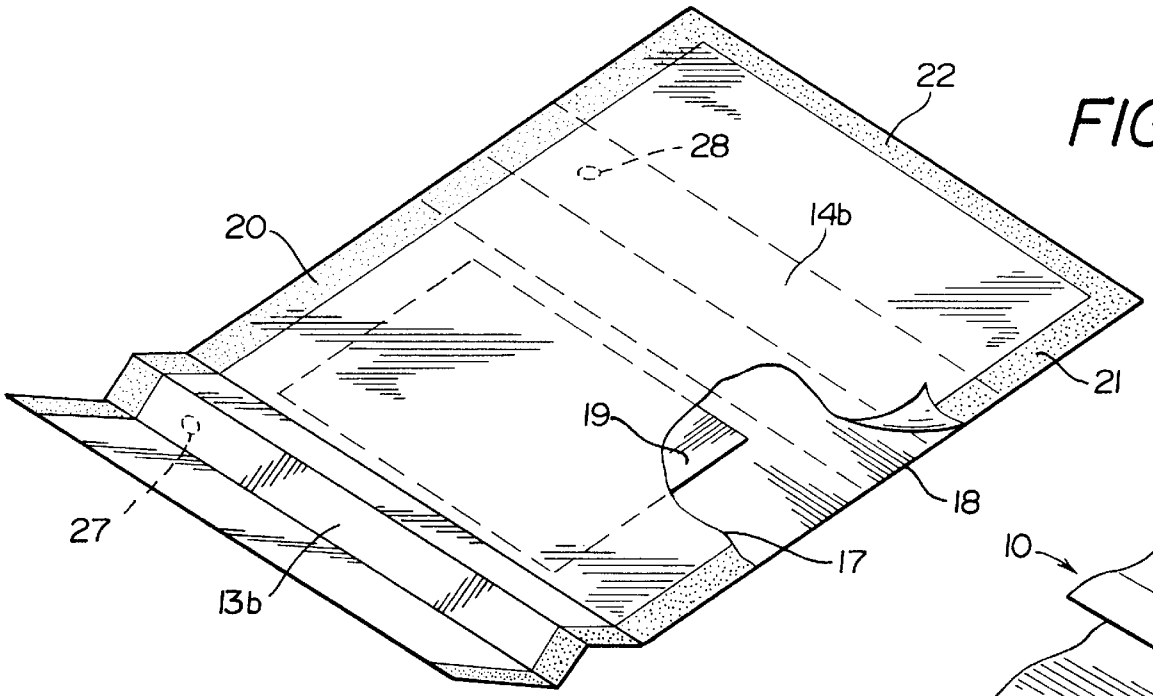
FIG. 4 is a top perspective view of the interior surface of an unfolded blank used to form a gusseted bag, with portions broken away, showing the bands of adhesive that are applied to the inner surface to secure the bag in erected condition and form the end closure seals and the longitudinal back seam.
Figure 5:
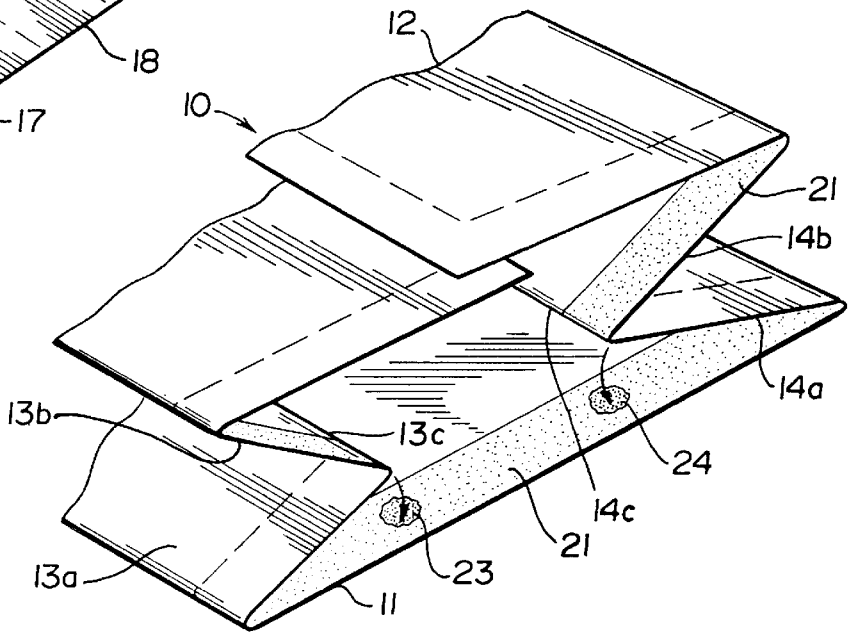
FIG. 5 is an enlarged fragmentary perspective view showing the bottom end of the blank of FIG. 4 after it has been partially folded into operative position but before the confronting sections that have been coated with adhesive are pressed together to adhesively attach them, with dots of flowable adhesive applied in the adhesive band extending across the bottom end of the bag.
Figure 7:
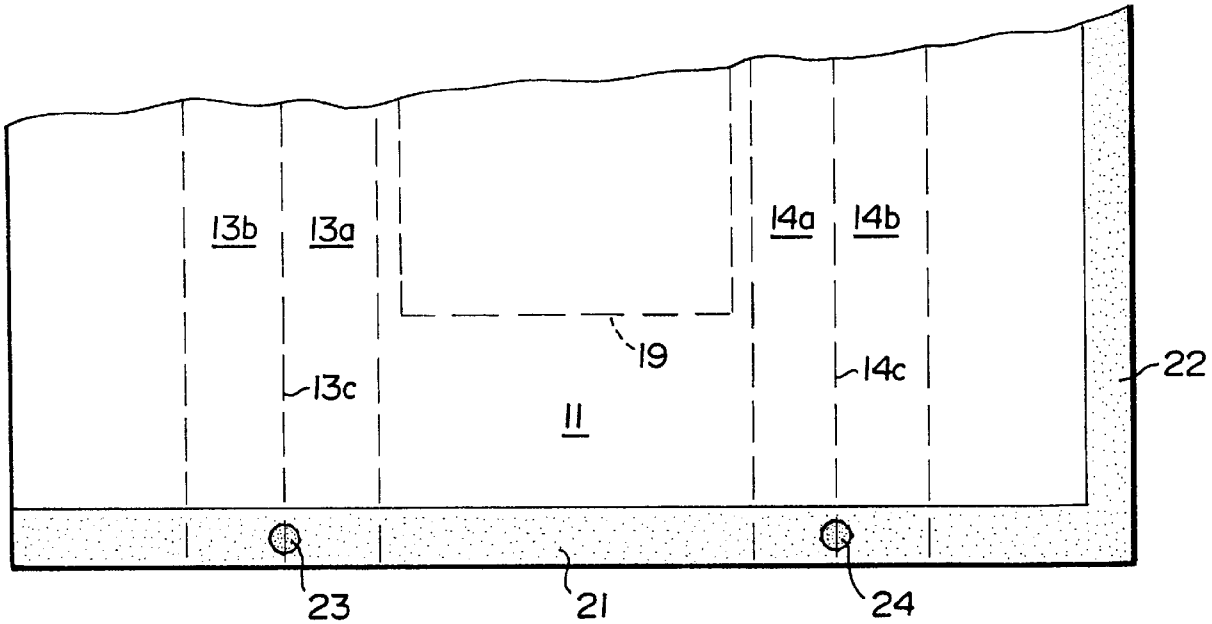
FIG. 7 is a fragmentary plan view of the interior surface of a bag blank according to the invention, showing an alternate location for the application of the spots of flowable adhesive, wherein the spots are placed on the medial fold of the gusseted side walls.

During manufacture of the bag, transverse bands of adhesive 20 and 21 are placed on the inner surface of the inner ply, along the top and bottom edges of the bag wall blank, and a longitudinal band of adhesive 22 is placed along one longitudinal edge of the blank, as depicted in FIG. 4. Additionally, although not shown in this figure, small patches or spots of a flowable adhesive 23 and 24 are placed in the field of the transverse band of adhesive 21 at locations which will correspond to the locations of the inner medial folds of the gusseted side walls where they cross or intersect the band of adhesive 21. As shown in FIG. 5, these spots of adhesive 23 and 24 can be placed on the front panel 11, or as shown in FIG. 7, they can be placed in the field of the transverse band of adhesive 21 on the inner medial fold lines 13*c* and 14*c*. The front and back walls and the gusseted side walls are then folded inwardly as depicted in FIG. 5, and pressed together to adhesively secure and seal the ends and the longitudinal seam.

The spots of adhesive 23 and 24 are applied in a flowable condition and in sufficient quantity so that when the confronting surfaces of the bag are pressed together, the adhesive 23 and 24 will flow into and fill the small spaces or channels that exist where the medial folds 13*c* and 14*c* cross the band of adhesive 21, thus insuring that leakage cannot occur through those areas.

Figure 8:
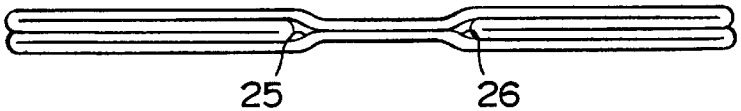
FIG. 8 (PRIOR ART)
FIG. 8 is a somewhat schematic end view of the bottom end of a prior art gusseted bag after it has been closed and sealed, showing the channels or spaces that can remain at the inner, medial fold of the gusseted side walls where they cross or intersect the end seal, if the spots of flowable adhesive are not applied in accordance with the invention.

In the absence of the spots of adhesive 23 and 24, small spaces or channels 25 and 26 exist adjacent the inner medial fold of the gusseted side walls, as depicted in FIG. 8, which shows a prior art arrangement. These spaces are the result of the step created by the transition from two layers of bag wall material, i.e., the front and back walls, along the longitudinal center of the bag, to four layers of bag wall material, i.e., the gusseted side walls and the front and back walls, along opposite sides of the bag. When the bag is pressed to adhesively secure the longitudinal and end seals, imperfect or inadequate pressure may be applied at these steps, with the result that a small space or channel remains unsecured and unsealed where the gusset fold extends across the end seal. This space then enables cooking oil or other material to leak from the interior of the bag during and after cooking.

The strips of adhesive 20 and 21 may comprise any suitable commercially available material and may be thermosetting or thermoplastic, so long as the bottom seal remains intact and does not open during or after cooking of the food, but which enables the top seal to be opened by grasping the corner flaps formed by the gusseted side panels and the front and back panels, respectively, to open the bag in a conventional manner. Moreover, the adhesively secured top end of the bag should open slightly to form a vent during cooking of the food in the bag.

The spots of adhesive 23 and 24 may also comprise any material suitable for the intended purpose, but a preferred adhesive is manufactured and sold by Airflex Corporation under the trade name "Airflex 400". In a preferred bag construction, these spots of adhesive are applied with a diameter of from about ⅛ inch to about ¼ inch, and spaced about ⅛ inch from the inner or top edge of the band of adhesive 21, in a quantity sufficient to fill the spaces 25 and 26.

If desired, the bag of the invention may also incorporate spots of adhesive 27 and 28 as in applicant's earlier U.S. Pat. No. 5,488,220, between the back wall 12 and the adjacent gusset panels 13*b* and 14*b*, in positions determined to lie immediately adjacent the diagonal folds 29 and 30 that will form between the expanding portions of the gusseted side panels and the secured end portions thereof when the bag expands during cooking of the food therein. These spots of adhesive prevent the formation of pockets that may otherwise form in the corner flaps of the bag, into which food may migrate during handling and cooking. As noted in applicant's earlier U.S. Pat. No. 5,488,220, the spots of adhesive 27 and 28 may be located between the gusset side panels and either the front or back wall of the bag, at either the top or bottom end thereof, or any combination of these locations.

It should be noted that suitable indexing means (not shown) may be provided on the bag so that the position of the spots 23 and 24 and 27 and 28 may be automatically adjusted by repositioning the adhesive applying means (not shown) during manufacture of the bag to compensate for minor variations in bag dimensions or placement of the fold lines. Additionally, the spots of adhesive preferably comprise a flowable adhesive material that enables the adhesive to spread out and accommodate itself to the pressure applied during manufacture of the bag, thereby adjusting itself to slight variations in bag structure.

While particular embodiments of the invention have been illustrated and described in detail herein, it should be understood that various changes and modifications may be made to the invention without departing from the spirit and intent of the invention as defined by the scope of the appended claims.

What is claimed is:

1. A bag of tubular construction having at least one closed end, comprising:

opposed front and back walls of substantially rectangular shape and having top and bottom ends and opposite side edges;

opposed gusseted side walls joined along longitudinal fold lines to the opposite side edges of the front and back walls, defining a tubular structure, said side walls each having a longitudinal medial gusset fold therein defining a pair of gusset panels that overlie one another between the front and back walls when the bag is folded flat, with the medial gusset folds of the opposed side walls being disposed between the front and back walls and in spaced apart relationship to one another, said gusseted side walls being expandable about the folds therein to enlarge the interior volume of the bag;

a transverse band of adhesive extending across at least one end of the bag on an interior surface thereof to secure the front and back walls to adjacent gusset side panels when the bag is folded and pressed together during manufacture, defining a bag end closure that closes and seals the end of the bag;

said medial gusset folds extending through the bag end closure, defining a step or transition in thickness where the medial gusset folds intersect the bag end closure; and a small field of sealant material at the intersection of the medial gusset folds and the bag end closure to seal and close any space that may result from the transition in thickness or step occurring at that location, thereby avoiding leakage of material from the interior of the bag through the bag end closure.

2. A bag as claimed in claim 1, wherein:

the sealant material comprises a spot of adhesive placed between the confronting surface portions of the respective front and back walls and gusset side panels.

3. A bag as claimed in claim 2, wherein:

the adhesive comprises a flowable material whereby it can flow into and fill any voids or spaces when the walls of the bag are pressed together during manufacture to adhesively secure the bag end closure.

4. A bag as claimed in claim 3, wherein:

a microwave susceptor is provided in the front panel.

5. A bag as claimed in claim 3, wherein:

the spots of adhesive are placed on an interior surface of the front wall, in the field of adhesive forming the bag end closure, and in a location corresponding to the area where the medial gusset fold will intersect the bag end closure when the bag is folded during manufacture.

6. A bag as claimed in claim 3, wherein:

the spots of adhesive are placed in the field of adhesive forming the bag end closure, on a line where the medial gusset fold intersects the bag end closure.

7. A bag as claimed in claim 1, wherein:

the bag is of multiple ply construction, including a grease-resistant inner ply and a machine-finished outer ply laminated thereto and on which high quality graphics may be applied.

8. A bag as claimed in claim 7, wherein:

a microwave susceptor is laminated between the inner and outer plies of the front panel.

9. A bag as claimed in claim 8, wherein:

the sealant material comprises a spot of adhesive placed between the confronting surface portions of the respective front and back walls and gusset side panels.

10. A bag as claimed in claim 9, wherein:

the adhesive comprises a flowable material whereby it can flow into and fill any voids or spaces when the walls of the bag are pressed together during manufacture to adhesively secure the bag end closure.

11. A bag as claimed in claim 10, wherein:

the spots of adhesive are placed on an interior surface of the front wall, in the field of adhesive forming the bag end closure, and in a location corresponding to the area where the medial gusset fold will intersect the bag end closure when the bag is folded during manufacture.

12. A bag as claimed in claim 10, wherein:

the spots of adhesive are placed in the field of adhesive forming the bag end closure, on a line where the medial gusset fold intersects the bag end closure.

* * * * *